US005938550A

United States Patent [19]

Hexemer et al.

[11] Patent Number: 5,938,550

[45] Date of Patent: Aug. 17, 1999

[54] WOMEN'S LACROSSE STICK HEAD

[75] Inventors: Matthew Gerald Hexemer, Toronto; Steven Copeland, Barrie; Roger MacLaren Ball, Toronto, all of Canada

[73] Assignee: Sports Licensing, Inc., Hanover, N.H.

[21] Appl. No.: 09/050,210

[22] Filed: Mar. 30, 1998

[51] Int. Cl.[6] ..... A63B 59/02

[52] U.S. Cl. ..... 473/513

[58] Field of Search ..... 473/513

[56] References Cited

U.S. PATENT DOCUMENTS 5,651,549 7/1997 Dill et al. ..... 473/513

*Primary Examiner*—William H. Grieb
*Attorney, Agent, or Firm*—Brian M. Dingman

[57] ABSTRACT

A women's lacrosse stick head generally comprising a frame and netting wherein the frame comprises a throat portion, sidewalls diverging from the throat portion, and a lip portion joining the sidewalls distal from the throat portion, wherein the sidewalls have a bottom edge provided with a plurality of concavities and apices, including a notchback area proximate to the throat portion to create a pocket, yet enabling a lacrosse ball to clear the top edge of the sidewalls.

7 Claims, 2 Drawing Sheets

WOMEN'S LACROSSE STICK HEAD

FIELD OF THE INVENTION

This invention relates to lacrosse sticks and more specifically to women's lacrosse stick heads having improved handling and playing characteristics while enabling a lacrosse ball to clear the upper edge of the sidewalls.

BACKGROUND OF THE INVENTION

Lacrosse sticks having a net and a frame with sidewalls generally configured to catch, carry and throw a lacrosse ball are well known in the art. However, although men's and women's lacrosse stick have many similarities, the rules for women's lacrosse require that a portion of the lacrosse ball always be visible above the top edge of the sidewalls of the women's lacrosse stick head. As a result, women's lacrosse stick heads heretofore do not have a defined pocket in the netting because the longitudinal thongs and transverse strings or mesh are tightly strung across the lower edges of the frame to maintain the lacrosse ball at the required height within the lacrosse stick head. This design makes catching and throwing, and running with, the lacrosse ball difficult because the ball has a tendency to bounce or ricochet out of the lacrosse stick head.

Although there are women's lacrosse sticks available with higher sidewalls intended to reduce handling difficulties, these higher sidewalls result in a heavier lacrosse stick, thereby slowing down the speed of the lacrosse head during play and reducing the player's accuracy.

SUMMARY OF THE INVENTION

It is therefore a primary object of this invention to provide a women's lacrosse stick with improved handling capabilities.

It is a further object of this invention to provide a women's lacrosse stick head which includes a defined pocket in the netting and which complies with the rules of women's lacrosse.

It is a further object of this invention to provide a women's lacrosse stick having a frame and netting so configured as to more readily retain a lacrosse ball within the lacrosse head while catching and throwing, and running with, the ball while maintaining the ball at a height within the lacrosse stick head so that a portion of the ball clears the upper edge of the sidewalls of the lacrosse stick head.

A preferred embodiment of the women's lacrosse stick head of this invention comprises a frame and a netting attached to the frame, wherein the frame and netting are so configured as to form a pocket in the netting and to receive a lacrosse ball in the pocket, wherein the frame comprises, a throat portion; two sidewalls diverging from the throat portion, each sidewall having a bottom and a top edge; a transverse lip portion joining the two sidewalls distal from the throat portion; and wherein the bottom edge of each sidewall comprises a plurality of concavities and angular apices including a notchback area proximate to the throat portion and wherein the netting follows the shape of the bottom edges of each sidewall. The notchback area of the preferred embodiment is generally concave, defined by a first angular apex immediately adjacent to said throat portion, a rounded concavity, and a second angular apex.

The preferred embodiment of this invention may further include a plurality of concavities and angular apices which comprise three or more angular apices, one or more rounded concavities, and one or more angular concavities which together may form two or more notches in the bottom edges of one or both of the sidewalls. These notches preferably do not lie in the same vertical plane and may thus form a downward facing edge juxtaposed to each notch.

The sidewalls of the women's lacrosse stick head of the preferred embodiment may be formed to angle inwards toward a central axis, defined by the center of the throat portion, so that the bottom edges of the sidewalls are closer to the central axis than the top edges of the sidewalls. The inward angle of the sidewalls preferably becomes less sharp in the direction from the throat portion to the lip portion.

Another preferred embodiment of the women's lacrosse stick head of this invention may comprise sidewalls provided with a series of serrations along the bottom edges of the sidewalls. These serrations may be irregularly spaced along the length of the sidewalls and may be irregular in shape.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE PREFERRED EMBODIMENT

This invention generally comprises a women's lacrosse stick head comprising, a frame made up of a throat portion; two sidewalls having a notchback area and which diverge from the throat portion; a lip portion joining the sidewalls distal from the throat portion; and a netting, together configured so as to form a pocket in the netting to more readily catch and throw, and run with, a lacrosse ball while simultaneously maintaining the lacrosse ball at a height within the lacrosse stick head to clear the top edge of the frame's sidewalls.

Figure 1:
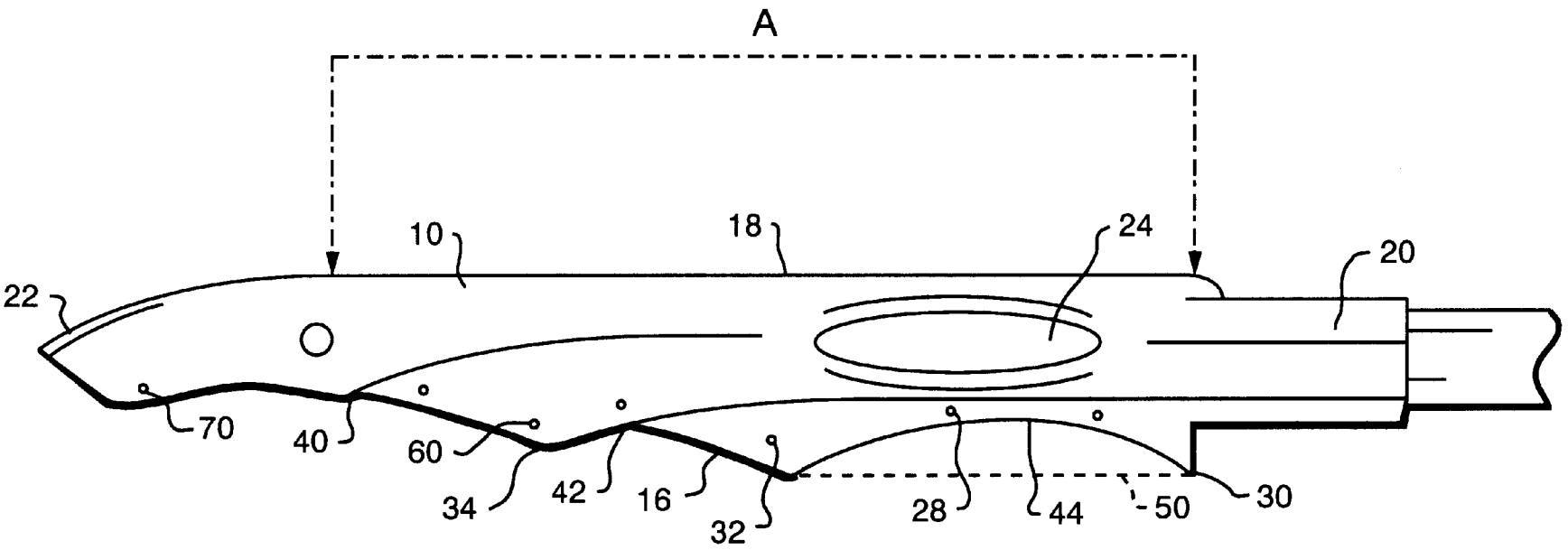
FIG. 1 is a lateral view of the left side of a preferred embodiment of the invention.

FIG. 1 illustrates a preferred embodiment of the women's lacrosse stick head of this invention. The lacrosse stick head of this invention generally comprises frame 10 and a web attached to the frame. Together longitudinal thongs 80 (shown in FIG. 2) and transverse netting materials (not shown) make up the web. Frame 10 and the longitudinal thongs 80 and transverse netting materials are so configured as to form a pocket in the netting to more readily handle a lacrosse ball. Frame 10 comprises a throat portion 20; two sidewalls 24 and 26 diverging from throat portion 20; and transverse lip portion 22. For purposes of this invention, sidewall 24 is that portion of frame 10 defined by arrow A shown in FIGS. 1 and 2. Sidewall 26 is that portion of frame 10 opposite of and corresponding to arrow A. Each sidewall has a bottom edge and a top edge generally referred to as bottom edge 16 and top edge 18. Transverse lip portion 22 joins sidewalls 16 and 18 distal from throat portion 20.

Bottom edge 16 of sidewalls 24 and 26 comprise a plurality of concavities 40, 42 and 44 and angular apices 30, 32, and 34, including notchback area 28 provided proximate to throat portion 20. Although the height of sidewall 24 between concavity 44 and top edge 18 should be less than the height of sidewall 24 between apex 32 and top edge 18, the height of sidewall 24 between concavity 44 and top edge 18 is preferably 65 to 75% the height of sidewall 24 between apex 32 and top edge 18. The concavities and apices of the preferred embodiment may comprise a series of serrations along the bottom edges of the sidewalls. These serrations may be irregularly spaced along the length of the sidewalls and may be irregular in shape.

Figure 2:
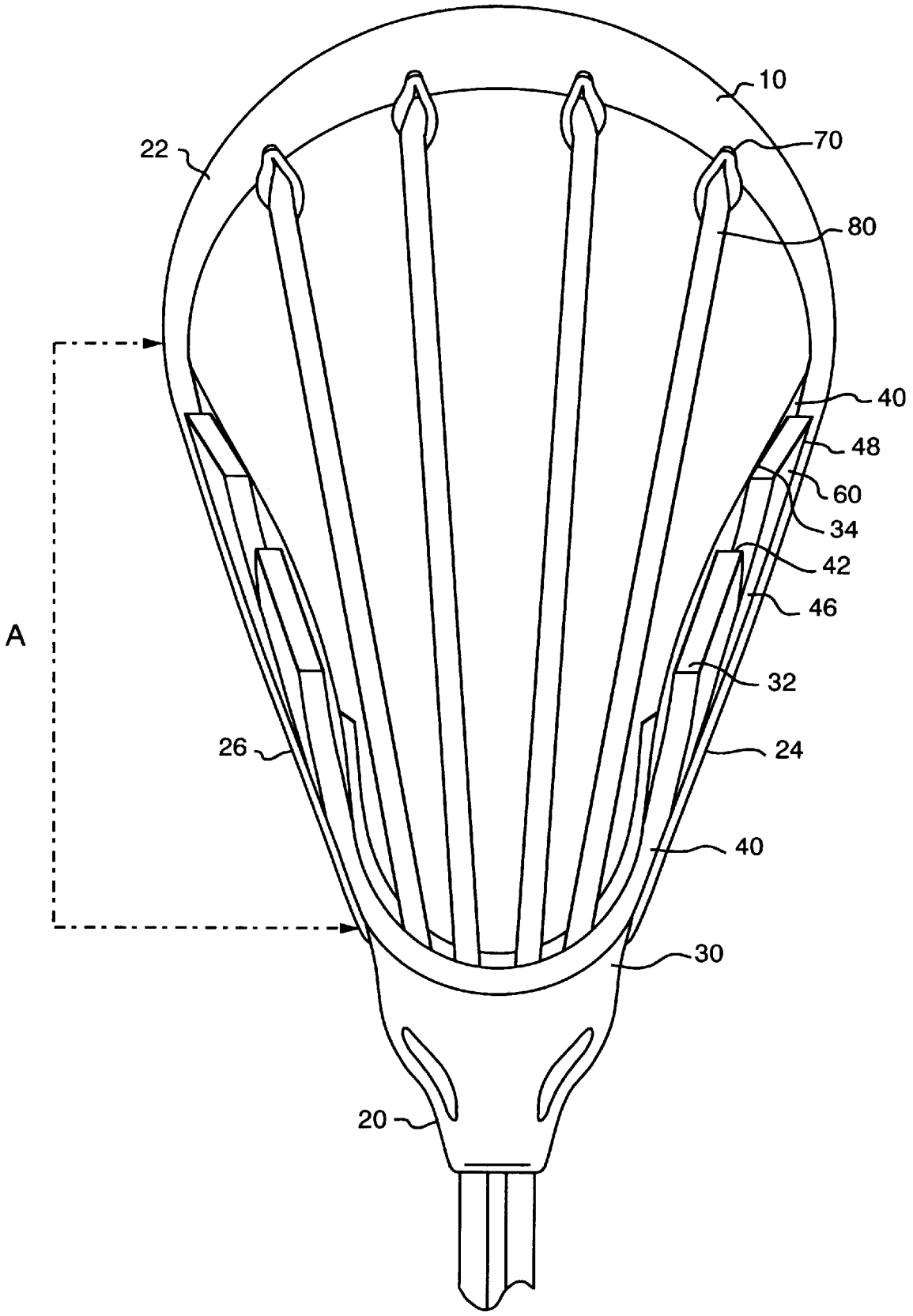
FIG. 2 is a perspective view of the bottom of a preferred embodiment of the invention.

Vertical thongs 80 are threaded through thong holes 70 and throat portion 20, as shown in FIGS. 1 and 2, and the transverse netting material, (not shown), is tightly strung through netting holes provided proximate to bottom edge 16 on both sidewalls 24 and 26, illustrated by netting hole 60. As threaded, the transverse netting material generally follows the shape of bottom edges 16 of sidewalls 24 and 26. Together, the concavities and the angular apices of the bottom edges of frame 10, with the netting, form a pocket in the netting located approximately at apex 32.

The depth, breadth and number of the concavities, or the height, angle of incidence and the number of the apices, may vary from the embodiments shown in the drawings to an extent that their combined dimensions, together with the thongs and transverse netting material, conform to the objects of the invention.

Notchback area 28 of the preferred embodiment is generally concave as shown in FIG. 1, and is defined by a first angular apex 30 located immediately adjacent to throat portion 20, rounded concavity 44, and second angular apex 32. The profile of the typical bottom edge of a women's lacrosse stick head is shown by dotted line 50 in FIG. 1. By providing notchback area 28 in the preferred embodiment of this invention, a lacrosse ball may be more securely held in a pocket formed at apex 32 while being laterally supported by the netting as it follows the shape of notchback area 28 and concavity 42.

The preferred embodiment of this invention may include more particularly, a lacrosse stick head wherein the plurality of concavities and angular apices comprise three or more angular apices, one or more rounded concavities, and one or more angular concavities which together may form two or more notches in the bottom edges of one or both of the sidewalls as shown in FIGS. 1 and 2. These notches preferably do not lie in the same vertical plane and may thus form downward facing edges 46 and 48 juxtaposed to the notches as shown in FIG. 2. A notch comprises a concavity with relatively steep walls having upper points defined by two opposing apices. Other embodiments of these concavities, apices and notches are envisioned which may include alternative angles of incidence and planar positions than those shown in the drawings. These embodiments are limited to the extent that they must comport with the objects of the invention.

Although specific features of the invention are shown in some drawings and not others, this is for convenience only as some feature may be combined with any or all of the other features in accordance with the invention. Other embodiments will occur to those skilled in the art and are within the following claims:

What is claimed is:

1. A women's lacrosse stick head comprising a frame and a web attached to said frame, wherein said frame and web are configured to form a pocket in said web and to receive a lacrosse ball in said pocket, wherein said frame comprises, a throat portion;

two sidewalls diverging from said throat portion, each sidewall having a bottom and a top edge;

a transverse lip portion joining said two sidewalls distal from said throat portion; and wherein the bottom edge of each sidewall comprises a plurality of concavities and angular apices including a notchback area proximate to said throat portion.

2. The women's lacrosse stick head of claim 1, wherein said plurality of concavities and angular apices comprise three or more angular apices, one or more rounded concavities, and one or more angular concavities.

3. The women's lacrosse stick head of claim 2, wherein said apices and concavities together form two or more notches in the bottom edges of said sidewalls.

4. The women's lacrosse stick head of claim 3, wherein said notches do not lie in the same vertical plane.

5. The women's lacrosse stick head of claim 1, wherein said notchback area is generally concave, defined by a first angular apex immediately adjacent to said throat portion, a rounded concavity, and a second angular apex.

6. The women's lacrosse stick head of claim 1, wherein said bottom edges of said sidewalls are provided with a series of serrations.

7. The women's lacrosse stick head of claim 6, wherein said serrations are irregularly spaced along said sidewalls.

* * * * *